US007712700B2

(12) United States Patent
McFarland et al.

(10) Patent No.: US 7,712,700 B2
(45) Date of Patent: May 11, 2010

(54) CLEAN-RELEASE TAPE CORE

(75) Inventors: Rodney McFarland, Hartsville, SC (US); Xiaokai Niu, Hartsville, SC (US); Tony Rummage, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 398 days.

(21) Appl. No.: 11/865,924

(22) Filed: Oct. 2, 2007

(65) Prior Publication Data

US 2009/0087600 A1 Apr. 2, 2009

(51) Int. Cl.
*B65H 75/10* (2006.01)

(52) U.S. Cl. ..... 242/613.2; 428/34.3

(58) Field of Classification Search ..... 428/34.3; 242/118.3, 613, 613.2, 613.1; 493/299
See application file for complete search history.

(56) References Cited

U.S. PATENT DOCUMENTS

| | | | |
|---|---|---|---|
| 2,659,543 | A | 11/1953 | Guyer |
| 2,676,765 | A | 4/1954 | Kaplan |
| 3,107,874 | A | 10/1963 | Wilke |
| 3,115,246 | A | 12/1963 | Wicklund |
| 3,289,973 | A | 12/1966 | Spencer |
| 3,448,774 | A | 6/1969 | Nelms |
| 4,462,556 | A | 7/1984 | Graham, Jr. |
| RE33,060 | E | 9/1989 | Cunningham et al. |
| 6,394,385 | B1 | 5/2002 | Rhodes et al. |
| 7,007,887 | B2 | 3/2006 | van de Camp |

FOREIGN PATENT DOCUMENTS

| | | | |
|---|---|---|---|
| EP | 0 399 488 | A2 | 11/1990 |
| EP | 1 598 297 | A1 | 11/2005 |
| GB | 2 402 384 | A | 12/2004 |
| WO | WO-02/44294 | A2 | 6/2002 |

OTHER PUBLICATIONS

International Search Report for International Application No. PCT/US2008/075659, dated Dec. 2, 2008.
Written Opinion for International Application No. PCT/US2008/075659, dated Dec. 2, 2008.

*Primary Examiner*—Alexander Thomas
(74) *Attorney, Agent, or Firm*—Alston & Bird LLP

(57) ABSTRACT

A core for a roll of pressure-sensitive adhesive tape comprises a paperboard material wound about an axis and adhered together to form a tubular body, and a polymer film layer wrapped about and adhered to the outer surface of the tubular body so as to form a tape-receiving surface upon which adhesive tape is to be wound. The polymer film layer has an overlap joint between the opposite edges of the polymer film ply. A recessed region is formed in the outer surface of the tubular body, the recessed region being recessed radially inwardly relative to the cylindrical outer surface. At least a portion of the length of the overlapping edge of the polymer film ply extends into and terminates in the recessed region such that the overlapping edge is not contacted by the adhesive tape wound about the core.

13 Claims, 2 Drawing Sheets

CLEAN-RELEASE TAPE CORE

CROSS-REFERENCE TO RELATED APPLICATIONS

This application is related to U.S. patent application Ser. No. 11/398,029 filed on Apr. 5, 2006, now abandoned, the entire disclosure of which is incorporated herein by reference.

BACKGROUND OF THE INVENTION

The invention relates to cores for pressure-sensitive adhesive tape such as medical tape used for bandaging, duct tape, masking tape, transparent plastic tape, and the like.

Pressure-sensitive adhesive tape is typically supplied in the form of a roll of the tape wound about a hollow cylindrical core. The core in most cases is a wound paperboard tube. It is desirable to be able to use all of the tape wound onto the core, particularly in the case of single-use rolls that may contain as little as 12 inches of tape. However, the first wrap of tape adheres to the paperboard surface of the core, and tends to pick up paper fibers and thus is contaminated and unusable. The first wrap can represent a significant fraction of the total length of tape on the roll, particularly in the case of single-use rolls. Thus, conventional tape cores can lead to significant waste of tape.

It has been proposed to use a polymer film ply such as a plastic carton-sealing tape or the like as the outermost ply of the tape core, so that the adhesive tape will release cleanly from the polymer film ply. Such carton sealing tape has a release coating on its outer surface and a pressure-sensitive adhesive on its inner surface. To completely cover the paper core surface, it is necessary to slightly overlap the edges of the polymer film ply. However, the overlapping edge adheres to the release surface of the overlapped edge, and thus does not bond as strongly as desired. While this approach is an improvement over conventional cores having a paper surface, there is a tendency for the tape to cause the overlapping edge of the polymer film ply to lift away from the overlapped edge. This is a problem especially when the polymer film ply is spirally wrapped about the core, because the overlapping edge forms an acute-angled "dog-ear" at one end of the core. If the pressure-sensitive adhesive tape unwinds from the core in the opposite direction from the direction in which the polymer film ply is wrapped, then the tape can peel the dog-ear back and the tape can become snagged on the polymer film ply and fail to release properly from the core.

BRIEF SUMMARY OF THE INVENTION

The present invention seeks to overcome this problem. In certain embodiments of the invention, the "dog-ear" of the polymer film ply is recessed such that the adhesive tape wound onto the core does not contact and adhere to the dog-ear. This can be accomplished by indenting or recessing the surface of the core where the dog-ear is located.

In accordance with one embodiment of the invention, a core for a roll of pressure-sensitive adhesive tape comprises a paperboard material wound about an axis and adhered together to form a tubular body having a cylindrical radially inner surface and a cylindrical radially outer surface and having opposite ends, and a polymer film layer wrapped about the outer surface of the tubular body and adhered thereto so as to form a tape-receiving surface upon which adhesive tape is to be wound. The polymer film layer has opposite edges one of which is an overlapping edge and the other of which is an overlapped edge, the overlapping edge overlapping the overlapped edge and being adhered thereto so as to form an overlap joint between the opposite edges of the polymer film ply. A recessed region is formed in the outer surface of the tubular body, the recessed region being recessed radially inwardly relative to the cylindrical outer surface. At least a portion of the length of the overlapping edge extends into and terminates in the recessed region such that the overlapping edge is not contacted by the adhesive tape wound about the core.

The polymer film ply in one embodiment is spirally wrapped about the outer surface of the tubular body such that the overlapping edge extends helically about the tubular body and forms a dog-ear at one of the opposite ends of the tubular body. The dog-ear terminates in the recessed region and is thus prevented from being contacted by and adhering to the adhesive tape wound about the core.

In one embodiment of the invention, the recessed region is formed as a beveled edge of the end of the tubular body, and the dog-ear is located on the beveled edge. Both ends of the tubular body can have the beveled edge.

In another embodiment, the recessed region extends helically along the tubular body beneath the overlapping edge such that the entire length of the overlapping edge terminates within the recessed region.

In still another embodiment, the recessed region extends longitudinally along the tubular body parallel to the axis of the core.

In other embodiments of the invention, the tape-receiving surface of the core has an undulating or irregular surface that reduces contact area between the adhesive tape and the core relative to a smooth cylindrical tape-receiving surface. The reduced contact area between the adhesive tape and the core outer surface serves to reduce the peel force needed to peel the tape off, and therefore reduces the likelihood of peeling away the dog-ear away of the polymer film ply. The tape-receiving surface in one embodiment is made undulating or irregular by embossing a radially outermost paperboard layer making up the tubular body, and wrapping the polymer film ply about the tubular body such that the polymer film ply generally conforms to the undulating or irregular surface.

In other embodiments, the core is caused to have an irregular outer surface by indenting the outer surface of the core. The irregular outer surface in one embodiment is created by forming a plurality of circumferential or spiral indentations in the outer surface, spaced apart along the length of the core.

Further improvement can be provided in any of the above embodiments by removing the release coating from the overlapped edge of the polymer film ply, such as by buffing the edge with a buffer, dissolving the release coating with a solvent, or other technique.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
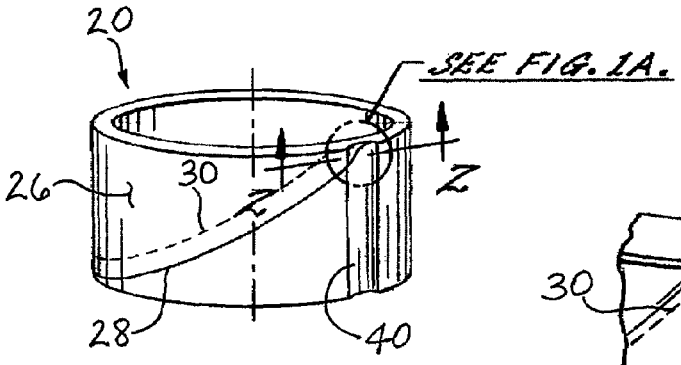
FIG. 1 is a perspective view of a tape core in accordance with a first embodiment of the invention.
Figure 2:
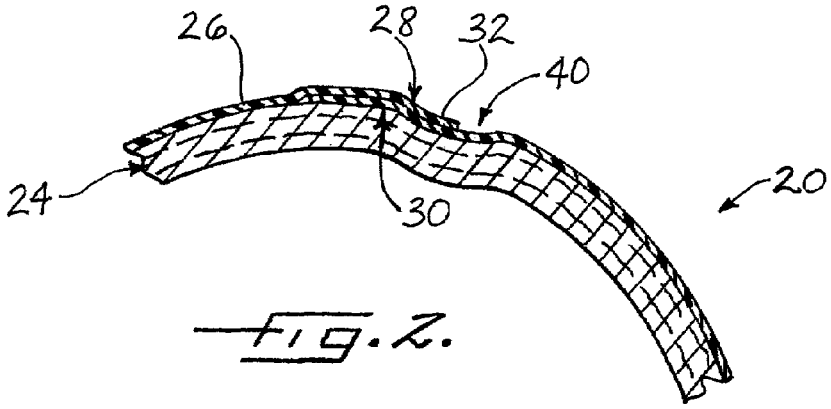
FIG. 2 is a cross-sectional view through the tape core along line 2-2 in FIG. 1.
Figure 3:
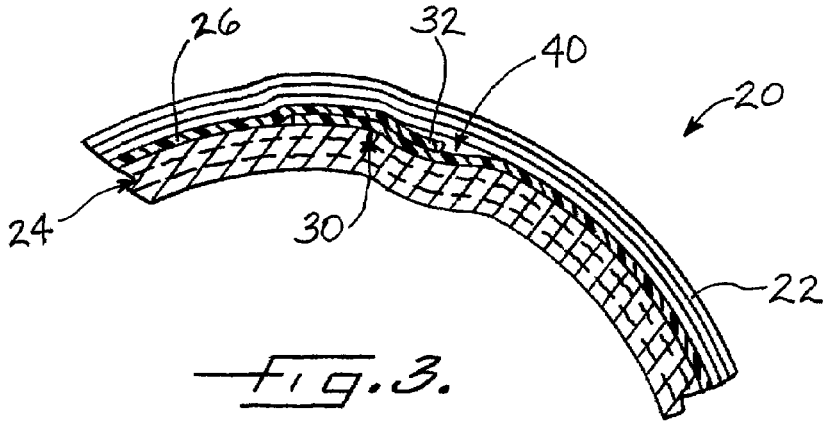
FIG. 3 is a view similar to FIG. 2, but showing several wraps of adhesive tape wound about the tape core.

A tape core 20 in accordance with a first embodiment of the invention is illustrated in FIGS. 1 through 3. The tape core is provided for wrapping pressure-sensitive adhesive tape 22 (FIG. 3) convolutely about the core to form a roll of the adhesive tape. The adhesive tape typically will have a tacky or pressure-sensitive adhesive on one surface, and the opposite surface may have a release material to reduce the adhesive bond between successive wraps of the tape so that the tape can readily be unwound from the roll. The tacky adhesive on the tape 22 in some cases can have a high tack (e.g., for medical bandaging tape, which must adhere to skin and remain adhered even after oils are exuded from the skin). Even with lower-tack tapes, however, the first wrap of tape about the core would tend to pick up paper fibers from the core if the core outer surface were formed of paper as in some conventional tape cores. Accordingly, the first wrap of tape would not be usable and would be wasted. This is a problem particularly with "single-use" tape rolls (e.g., single-use rolls of medical tape included in some first-aid kits or the like) in which the first wrap represents a significant percentage of the total length of tape in the roll.

The tape core 20 in accordance with the first embodiment of the invention includes a tubular body 24 formed of paperboard material, and an outermost polymer film ply 26 wrapped about the outer surface of the tubular body and adhered thereto. In accordance with one embodiment of the invention, the polymer film ply 26 comprises a polymer substrate having a release coating on its outer surface, and a tacky or pressure-sensitive adhesive on its inner surface for adhering the polymer film ply to the tubular body 24. The release coating forms the outermost surface of the tape core 20 upon which adhesive tape 22 or the like is to be wound (FIG. 3).

The polymer film ply 26 can comprise various materials. The polymer substrate can comprise a polyolefin such as polypropylene or polyethylene. The release coating can comprise any suitable material that tacky adhesives will readily release from, including but not limited to solvent-based urethanes, water-based silicones (optionally containing additives such as polyurethane), and the like. The selection of the release coating generally will depend upon the properties of the particular tacky adhesive employed. Various tacky adhesives can be used.

In one embodiment, the polymer film ply 26 comprises a carton-sealing tape comprising a polypropylene (e.g., BOPP) substrate having a solvent-based urethane release coating and a pressure-sensitive adhesive (e.g., a hot melt rubber-resin PSA). In another embodiment, the release coating comprises a water-based silicone and polyurethane composition.

Figure 1A:
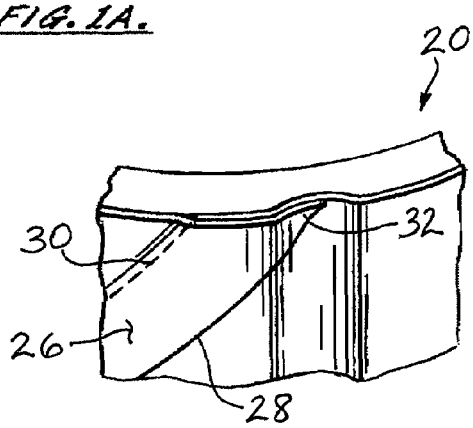
FIG. 1A is a magnified view of a portion of the tape core of FIG. 1.

The polymer film ply 26 is wrapped about the tubular body 24 such that opposite edges 28 and 30 of the ply overlap to form a straight lap joint as indicated in FIGS. 1 and 1A. The edge 28 overlaps the edge 30; thus, the edge 28 is termed the "overlapping edge" and the edge 30 is termed the "overlapped edge" herein. The ply 26 thus covers the entire outer surface of the tubular body so that all surfaces contacted by the first wrap of the adhesive tape are formed by the release coating on the polymer film ply 26. Although there is an exposed side edge of the polymer film substrate at the overlapping edge 28 that is not coated with the release coating, the substrate is very thin and hence the edge of the substrate does not present a problem in terms of the adhesive tape product sticking to the edge and preventing ready release of the tape from the core.

In the embodiment of FIGS. 1 through 3, the polymer film ply 26 is spirally wrapped about the tubular body 24. Accordingly, the overlap joint between the edges 28, 30 extends helically along the tubular body. At one end of the tubular body, the overlapping edge 28 forms a "dog-ear" 32, i.e., an acute-angled point formed by the intersection of the helically extending edge 28 and the circumferentially extending end edge of the ply 26 at the end of the core. With reference to FIG. 3, if the adhesive tape 22 is wound onto the core in the direction toward which the acute-angled dog-ear 32 generally points (clockwise in FIG. 3), then the unwinding of the tape (counterclockwise in FIG. 3) will tend to peel the dog-ear 32 back if the tape adheres to the dog-ear. This phenomenon can hinder the first wrap of tape from cleanly releasing from the core.

The objective of the invention is to prevent such adhering of the tape to the dog-ear 32, or at least to reduce the strength of the adhesive bond between the tape and the dog-ear so that the incidence of the dog-ear being peeled back and hindering the clean release of the first wrap of tape from the core can be substantially reduced or eliminated.

In accordance with the first embodiment in FIGS. 1 through 3, the tape core 20 includes a recessed region 40 formed in the outer surface of the tubular body 24, the recessed region being recessed radially inwardly relative to the cylindrical outer surface of the tubular body. The polymer film ply 26 is wrapped such that at least a portion of the length of the overlapping edge 28 extends into and terminates in the recessed region 40. In particular, the dog-ear 32 extends into and terminates in the recessed region 40 as best seen in FIG. 1A.

The recessed region 40 can be localized and confined to the end of the core 20 at which the acute-angled dog ear 32 is located. Alternatively, as illustrated in FIG. 1, the recessed region 40 can extend longitudinally along the full length of the core, parallel to the axis of the core.

The dog-ear 32 is "hidden" in the recessed region 40 such that the dog-ear is not contacted by the adhesive tape 22, as illustrated in FIG. 3. Consequently, when the first wrap of adhesive tape in contact with the polymer film ply 26 is unwound (counterclockwise in FIG. 3), the dog-ear will remain adhered to the overlapped edge 30 in the recessed region 40 and therefore will not be peeled back. The tape thus will cleanly release from the core. The entire length of the tape is usable because the tape does not contact and pick up paper fibers from the paperboard body 24.

Figure 4:
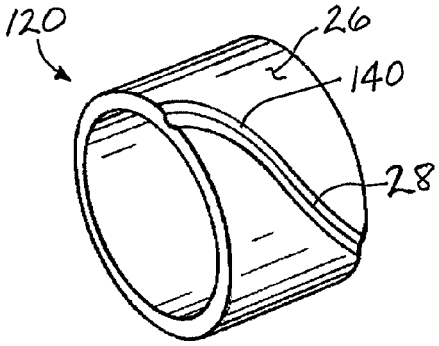
FIG. 4 is a perspective view of a tape core in accordance with a second embodiment of the invention.

A tape core 120 in accordance with a second embodiment of the invention is illustrated in FIG. 4. The tape core 120 is generally similar to the tape core 20 of the first embodiment, except for the configuration of the recessed region. The tape core 120 includes a recessed region 140 that extends helically along the tape core at the same spiral angle at which the polymer film ply 26 is wrapped. The overlapping edge 28 of the polymer film ply extends into and terminates in the recessed region 140. Thus, the entire length of the overlapping edge 28 is "hidden" in the recessed region 140.

Figure 5:
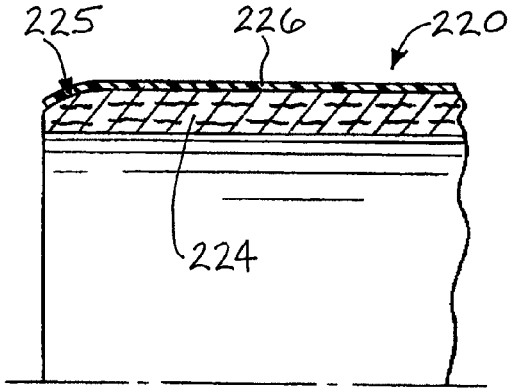
FIG. 5 is an axially sectioned side view of a tape core in accordance with a third embodiment of the invention.

A tape core 220 in accordance with a third embodiment of the invention is shown in FIG. 5. The tape core includes a tubular body 224 of paperboard and an outer polymer film ply 226 generally as described above. At the end of the tubular body 224 at which the acute-angled dog-ear of the polymer film ply 226 is located, the end of the tubular body includes a beveled edge 225 that extends generally conically from the cylindrical outer surface of the tubular body. The polymer film ply 26 is wrapped about the tubular body such that at the end of the tubular body the ply extends onto the beveled edge 225. Therefore, the dog-ear is located on the beveled edge and is thus kept from contacting and adhering to the adhesive tape when it is wound about the core. Both ends of the core can include the beveled edge.

Figure 6:
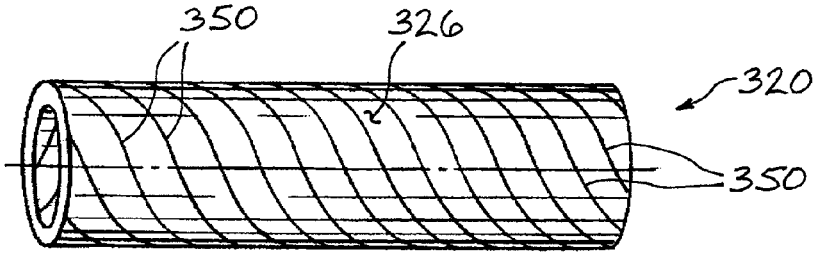
FIG. 6 is a perspective view of a tape core in accordance with a fourth embodiment of the invention.

FIG. 6 depicts a tape core 320 in accordance with a fourth embodiment of the invention. The tape core 320 operates on a somewhat different principle from the prior embodiments. The tape core includes a paperboard body and an outer polymer film ply 326 generally as in the prior embodiments. However, instead of (or in addition to) including a recessed region for "hiding" the dog-ear of the polymer film ply, the outer surface of the core 320 is operated upon to form a series of helically extending indentations 350 that are axially spaced along the core. The indentations 350 are formed in such a manner that the polymer film ply 326 is indented along with the underlying paperboard body. Consequently, the tape-receiving surface of the core 320 that is contacted by the first wrap of adhesive tape is reduced in surface area relative to a smooth cylindrical core surface, since the adhesive tape does not contact the polymer film ply at the indentations 350. In this manner, the peel force required to peel off the adhesive tape is reduced, and therefore the likelihood of peeling back the dog-ear of the polymer film ply is reduced or eliminated.

The helical indentations 350 can be formed as grooves in the core's outer surface by depressing the outer surface with a suitable tool so as to permanently or plastically deform the core. This operation can be formed immediately after formation of the core while the adhesive used for joining the paperboard material of the core together is still wet or uncured and the moisture content of the paperboard is relatively high such that the paperboard is readily deformable.

Figure 7:
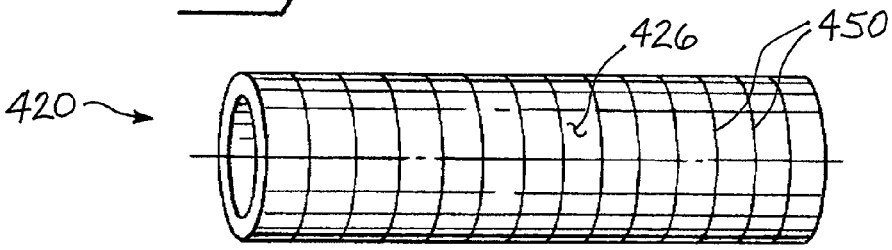
FIG. 7 is a perspective view of a tape core in accordance with a fifth embodiment of the invention.

FIG. 7 illustrates a tape core 420 in accordance with a fifth embodiment of the invention. The tape core 420 is generally similar to the tape core 320, having a polymer film ply 426 wrapped about a tubular paperboard body, except that the indentations 450 in the core's outer surface extend in the circumferential or hoop direction rather than the helical direction.

The embodiments of FIGS. 6 and 7 are merely exemplary. More generally, the invention is applicable to any tape core having a paperboard body and an outer polymer film ply, wherein the outer surface of the core is made undulating or irregular, such as by helical or circumferential indentations or by indentations of other configurations, in order to reduce the contact area between the core and adhesive tape wound about the core.

Figure 8:
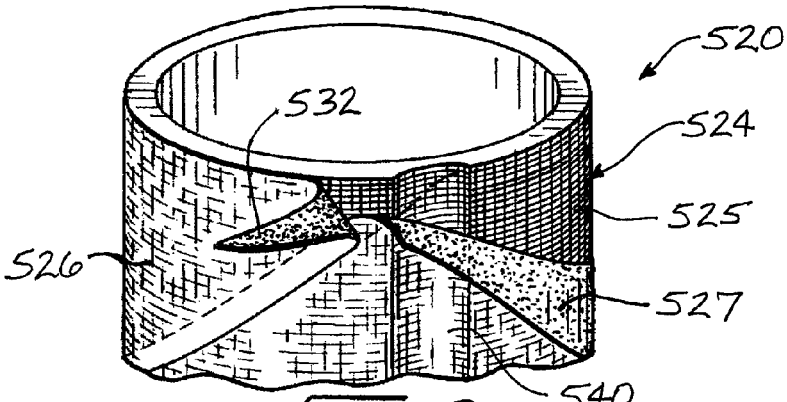
FIG. 8 is a perspective view of a tape core in accordance with a sixth embodiment of the invention.

A sixth embodiment of the invention is depicted in FIG. 8, showing a tape core 520. The tape core includes a paperboard body 524 and an outer polymer film ply 526 generally as in the previously described embodiments. The polymer film ply is adhered to the body 524 by a pressure-sensitive adhesive 527. The tubular body 524 includes a recessed region 540 generally similar to the recessed region 40 of the first embodiment of FIG. 1, for "hiding" the dog-ear 532 of the polymer film ply 526. The two edges 528, 530 of the film ply are peeled back in FIG. 8 to reveal the underlying outer surface 525 of the paperboard body 524, which is made to be irregular or undulating. This can be accomplished when forming the tubular body 524 by employing a radially outermost paperboard ply that is embossed or otherwise undulating or irregular. The polymer film ply 526 is sufficiently thin and flexible that it generally conforms to the surface 525 of the tubular body. The ply 526 can be softened by heating and wrapped about the tubular body under tension in order to facilitate such conformance to the irregular or undulating surface 525, if desired. Accordingly, the polymer film ply 526 also has an undulating or irregular surface that reduces the contact area to which adhesive tape adheres when wound about the core.

The tubular bodies 24, 124, 224, etc., of the various embodiments can be formed either by a spiral winding process or by a convolute winding process. The spiral winding process is preferred because a tube is continuously formed and cut into lengths, which is more-efficient than the convolute process wherein each length must be individually formed. As known in the art, a tube is formed in accordance with the spiral winding process by advancing a plurality of paperboard plies toward a cylindrical mandrel, applying adhesive to the plies, and wrapping the plies one upon another about the mandrel in a spiral or helical fashion so as to form a continuous tube on the mandrel. The polymer film ply 26, 126, 226, etc., advantageously is spirally wrapped about and adhered to the paperboard tube while it is on the mandrel, and the resulting tube is then cut into lengths sometimes called "parent tubes". The parent tubes each can then be cut into individual tape cores, which can then be processed to form the recessed regions 40, 140, etc. In the case of a tape core such as in FIG. 1 or FIG. 8 wherein the recessed region 40, 540 extends longitudinally, each tape core must be operated upon individually to form the recessed region at the location of the dog-ear 32, 532. Similarly, when the tape core has a beveled edge as in FIG. 5, each tape core must be operated upon individually to form the beveled edge at one or both ends of the core.

On the other hand, when the recessed region extends helically beneath the helical overlap joint of the polymer film ply such as in FIG. 4, a parent tube can be processed to form the helical recessed region 140 along the full length of the tube, and then the parent tube can be cut into smaller lengths for use as tape cores. For example, a parent tube 36 inches long can be processed to form the helical recessed region along its entire length, and then the tube can be cut into 18 tubes of 2-inch length each. The helical recessed region can be formed during the spiral tube-making process by using a suitable tool to depress the overlapping edge of the polymer film ply after it is wrapped about the paperboard tube on the mandrel so as to deform the tube. The continuously formed tube can be cut into parent tubes that are held until fully dried, after which the parent tubes can be cut into individual tape cores. Alternatively, the recessed region can be formed after the tube is removed from the mandrel, either by processing the parent tubes or by individually processing resulting tape cores.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A core for a wound roll of pressure-sensitive adhesive tape, the core comprising:

paperboard material wound about an axis and adhered together to form a tubular body having a cylindrical radially inner surface and a cylindrical radially outer surface and having opposite ends;

a polymer film layer wrapped about the outer surface of the tubular body and adhered thereto so as to form a tape-receiving surface upon which adhesive tape is to be wound, the polymer film layer having opposite edges one of which is an overlapping edge and the other of which is an overlapped edge, the overlapping edge overlapping the overlapped edge and being adhered thereto so as to form an overlap joint between the opposite edges of the polymer film ply, the overlapping edge having a length between the opposite ends of the tubular body; and a recessed region formed in the outer surface of the tubular body, the recessed region being recessed radially inwardly relative to the cylindrical outer surface, and at least a portion of the length of the overlapping edge extending into and terminating in the recessed region such that the overlapping edge is not contacted by the adhesive tape wound about the core.

2. The core of claim 1, wherein the polymer film ply is spirally wrapped about the outer surface of the tubular body such that the overlapping edge extends helically about the tubular body and forms a dog-ear at one of the opposite ends of the tubular body, wherein the dog-ear terminates in the recessed region.

3. The core of claim 2, wherein the recessed region is formed as a beveled edge of said one of the opposite ends of the tubular body, the dog-ear being located on the beveled edge.

4. The core of claim 3, wherein both ends of the tubular body have the beveled edge.

5. The core of claim 2, wherein the recessed region extends helically along the tubular body beneath the overlapping edge such that the entire length of the overlapping edge terminates within the recessed region.

6. The core of claim 2, wherein the recessed region extends longitudinally along the tubular body parallel to the axis.

7. The core of claim 1, wherein the tape-receiving surface of the core has an undulating or irregular surface that reduces contact area between the adhesive tape and the core relative to a smooth cylindrical tape-receiving surface.

8. The core of claim 7, wherein the tape-receiving surface is made undulating or irregular by embossing at least a radially outermost paperboard layer making up the tubular body, and wrapping the polymer film ply about the tubular body such that the polymer film ply generally conforms to the undulating or irregular surface.

9. The core of claim 7, wherein the tape-receiving surface is made undulating or irregular by embossing the polymer film ply.

10. The core of claim 7, wherein the tape-receiving surface is made undulating or irregular by indenting the tape-receiving surface after the polymer film ply has been wrapped about the tubular body.

11. The core of claim 10, wherein the tape-receiving surface defines a plurality of spaced indentations each formed generally as a groove.

12. The core of claim 11, wherein the indentations extend circumferentially about the core and are axially spaced along the core.

13. The core of claim 11, wherein the indentations extend helically about the core and are axially spaced along the core.

* * * * *